US006364530B1

(12) United States Patent
Buchman

(10) Patent No.: US 6,364,530 B1
(45) Date of Patent: Apr. 2, 2002

(54) RESEALABLE PACKAGE HAVING A SLIDER DEVICE AND VOID ARRANGEMENT

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/591,960

(22) Filed: Jun. 12, 2000

(51) Int. Cl.[7] ..... B65D 33/24
(52) U.S. Cl. ..... 383/64; 24/400
(58) Field of Search ..... 383/64; 24/399, 24/400

(56) References Cited

U.S. PATENT DOCUMENTS 3,259,951 A 7/1966 Zimmerman
3,790,992 A 2/1974 Herz
3,806,998 A 4/1974 Laguerre
5,020,194 A 6/1991 Herrington et al.
5,067,208 A 11/1991 Herrington, Jr. et al.
5,301,395 A 4/1994 Richardson et al.
5,431,760 A 7/1995 Donovan
5,442,837 A 8/1995 Morgan
5,722,128 A 3/1998 Toney et al.
5,871,281 A * 2/1999 Stolmeier et al. ..... 383/64

* cited by examiner

*Primary Examiner*—Jes F. Pascua

(57) ABSTRACT

A flexible package is disclosed comprising a package surrounding wall having first and second side seals and a mouth therebetween. The flexible package also includes a recloseable closure mechanism along the mouth for selective opening and closing of the mouth. The recloseable closure mechanism includes a first and second closure profile. Each of the closure profiles have an upper flange and a slider device for selectively opening and closing the recloseable closure mechanism. Furthermore, each of the first and second upper flanges define a slit adjacent to the first side seal. The slit accommodates the slider device such that the first and second upper flanges conform to the slider device when the slider device is positioned within the slit.

18 Claims, 7 Drawing Sheets

RESEALABLE PACKAGE HAVING A SLIDER DEVICE AND VOID ARRANGEMENT

FIELD

This disclosure generally relates to closure arrangements for polymer packages, such as, plastic bags. In particular, this disclosure relates to closure arrangements having resealable profiles and slider devices to open and close the profiles.

BACKGROUND

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

Some types of resealable packages are opened and closed using a slider device. The slider device typically includes a separator or spreader-type structure at one end that opens a closure mechanism, having profiled elements or closure profiles, when the slider device travels in a first direction along the mechanism. Conventional resealable packages include a notch formed in the upper flanges of the resealable closure mechanism. The notch serves as a "parking place" for the slider device and also facilitates mounting the slider device onto the resealable package. Additionally, one edge of the notch closest to the side edge of the resealable package creates a stop member for the slider device.

These conventional resealable packages have several shortcomings. For example, the notches formed in the upper flanges of the resealable packages are typically punched while the packages are being manufactured in an assembly line. Typically, the assembly line is stopped to allow the mechanical punch to form the notch in the resealable package. This reduces the productivity of the production line manufacturing the resealable packages and, therefore, increases the costs associated with manufacturing the resealable packages.

Furthermore, the mechanical punches used to form the notch in the resealable package are typically expensive. The cost of this equipment further increases the costs associated with manufacturing the resealable packages.

Improvements in the design and manufacture of resealable packages are desirable.

SUMMARY OF THE DISCLOSURE

In general terms, this disclosure relates to polymer packages with closure arrangements having resealable closure profiles and slider devices to open and close the profiles. In one aspect, a flexible package is disclosed comprising a package surrounding wall having first and second side seals and a mouth therebetween. The flexible package also includes a resealable closure mechanism, such as a recloseable zipper, along the mouth for selective opening and closing of the mouth. The zipper also includes a first and second closure profile, each having an upper flange. A slider device is operably mounted on the zipper for selectively opening and closing the resealable zipper. Furthermore, each of the first and second upper flanges defines a void arrangement adjacent to the first side seal. The void arrangement accommodates the slider device such that the first and second upper flanges conform to the slider device when the slider device is positioned within the void arrangement. In one variation, the void arrangement is a slit arrangement. In certain preferred arrangements, the slit arrangement includes a first slit cut in the upper flange of the first closure profile and a second slit cut in the upper flange of the second closure profile.

Methods of manufacturing a resealable package are described. The method includes the steps of providing a resealable closure mechanism having a first closure profile and a second closure profile., each of the closure profiles having an upper flange. A slider device is also provided for mounting on the resealable closure mechanism and for interlocking the first closure profile with the second closure profile when the slider device is moved in a first direction. The slider device also disengages the first closure profile from the second closure profile when the slider device is moved in a second opposite direction. Furthermore, the resealable closure mechanism defines a void arrangement oriented to trap the first and second upper flanges between portions of the slider device when the slider device is moved in the first direction.

DETAILED DESCRIPTION

Figure 1:
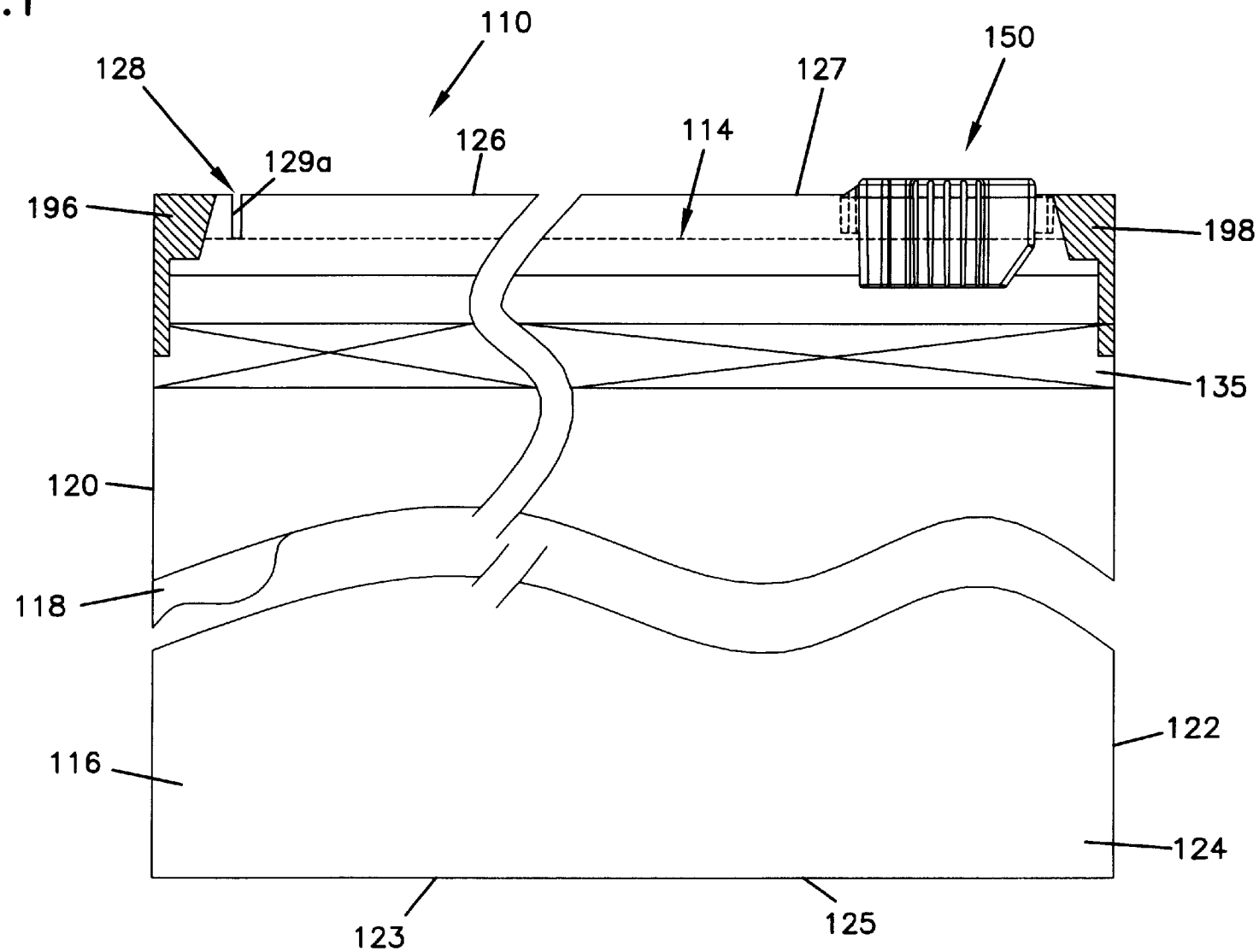
FIG. 1 is a fragmented, side elevational, schematic view of a first embodiment of a flexible, resealable package having a slider device, according to principles of this disclosure.

FIGS. 1–4 illustrate one example of a packaging arrangement in the form of a resealable, flexible package 110, for example, a polymeric package such as a plastic bag, having a resealable closure mechanism 114, for example, interlocking profiled elements, constructed in accordance with the principles of this disclosure. The flexible package 110 includes first and second opposed panel sections 116, 118, typically made from a flexible, polymeric, plastic film. With some manufacturing applications, the first and second panel sections 116, 118 are heat-sealed together along two side edges 120, 122 and meet at a fold line 123 in order to form a three-edged containment section for a product within an interior 124 of the package 110. In the embodiment shown, the fold line 123 comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at a top edge 127 of the package. In the particular embodiment shown, the mouth 126 extends the width of the package 110.

The resealable closure mechanism 114 is illustrated in FIG. 1 at the mouth 126 of the flexible package 110. In the embodiment shown, the resealable closure mechanism 114 extends the width of the mouth 126. Alternatively, the closure mechanism 114 could be positioned on the package 110 at a location different from the mouth 126 of the package 110, depending on the application needs for the package 110.

The resealable closure mechanism 114 can be one of a variety of closure mechanisms. In the particular embodiment illustrated in FIG. 5, the resealable closure mechanism 114 is shown in the specific form of a zipper-type closure mechanism. By the term "zipper-type closure mechanism," it is meant a structure having opposite interlocking or mating profiled elements that under the application of pressure will interlock and close the region between the profiles. Exemplary zipper-type closure mechanisms are disclosed in U.S. Pat. Nos. 4,240,241; 4,246,288; or 4,437,293; each of which is incorporated by reference herein.

Figure 5:
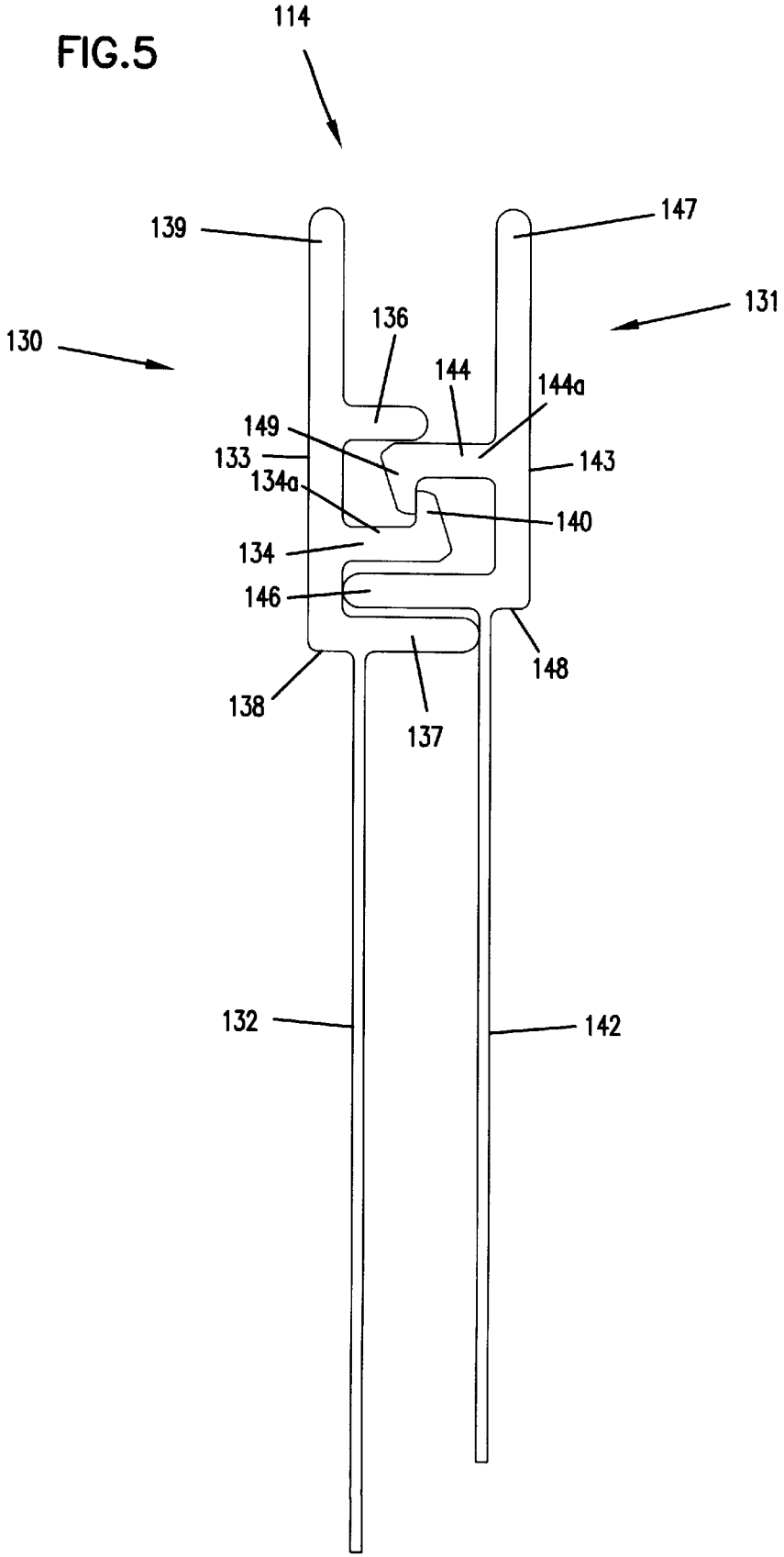
FIG. 5 is a cross-sectional view of a first embodiment of profiled elements usable with the resealable package of FIGS. 1–4, according to principles of this disclosure.

In particular, the zipper-type closure mechanism in FIG. 5 is an illustration of one example of a closure mechanism 114. The closure mechanism 114 includes an elongated first closure profile 130 and an elongated second closure profile 131. Typically, the closure profiles 130, 131 are manufactured separately from each other.

Still in reference to FIG. 5, the preferred first closure profile 130 depicted includes a sealing flange or bonding strip 132, a base strip 133, a first closure member 134, first and second guide posts 136, 137, and an upper flange 139. The closure member 134 extends from the base strip 133 by way of a stem 134*a* and is generally projecting from the base strip 133. At a free end of the stem 134*a* (the tip of the closure member 134) is a hook or catch 140. The guide posts 136, 137 also extend from the base strip 133 and are generally projecting from the base strip 133. The guide posts 136, 137 aid in holding the closure mechanism 114 closed and in aligning the first closure profile 130 with the second closure profile 131 for interlocking. The bonding strip 132 depends or extends downward from the second guide post 137 and can be attached to a first panel section, such as the first panel section 116 of the package 110 of FIG. 1 at region 135 (FIG. 1). A first shoulder 138 is defined by the intersection of the base strip 133 and bonding strip 132. In the example illustrated, the bonding strip 132 is spaced a distance laterally from the base strip 133 to define a corner forming the shoulder 138. The upper flange 139 extends upwardly from the base strip 133 and first guide post 136.

The preferred second closure profile 131 depicted includes a bonding strip 142, a base strip 143, a first closure member 144, a guide post 146, and an upper flange 147. The closure member 144 extends from the base strip 143 by way of a stem 144*a* and is generally projecting from the base strip 143. At a free end of the stem 144*a* (or tip of the closure member 144) is a hook or catch 149. The guide post 146 also extends from the base strip 143 and is generally projecting from the base strip 143. The guide post 146 aids in holding the closure mechanism 114 closed and aids in aligning the second closure profile 131 with the first closure profile 130 for interlocking. The bonding strip 142 depends or extends downward from the guide post 146 and can be attached to a second panel section, such as the second panel section 118 of the package 110 of FIG. 1. A shoulder 148, analogous to the shoulder 138, is formed at the corner of the bonding strip 142 and guide post 146.

The first and second closure profiles 130, 131 are designed to engage with one another to form the resealable closure mechanism 114. The closure member 134 of the first closure profile 130 extends from the base strip 133 a first distance. The closure member 144 of the second closure profile 131 also extends from the base strip 143 a first distance. These first distances that the closure members 134, 144 extend are sufficient to allow mechanical engagement, or interlocking, between the first closure member 134 ofthe first closure profile 130 and the first closure member 144 of the second closure profile 131. In particular, the catches 140, 149 hook or engage each other. Furthermore, the closure profiles 130, 131 may be sealed together at their ends, such as regions 196, 198 of FIG. 1, to further aid in aligning the closure profiles 130, 131 for interlocking through processes such as ultrasonic crushing. Pressure is applied to the closure profiles 130, 131 as they engage to form the openable sealed closure mechanism 114. Pulling the first closure profile 130 and the second closure profile 131 away from each other causes the two closure profiles 130, 131 to disengage, opening the package 110 of FIG. 1. This provides access to the contents of the package 110 through the mouth 126 (FIG. 1).

In some applications, the closure profiles 130, 131 are formed by two separate extrusions or through two separate openings of a common extrusion. Typically, the resealable closure mechanism 114 is made of conventional materials, such as a polymeric, plastic material, for example, polyethylene or polypropylene. In one example embodiment, the closure arrangement illustrated in FIG. 5 is manufactured using conventional extrusion and heat sealing techniques.

Still referring to FIG. 1, a slider device 150 is provided to open and close the resealable closure mechanism 114. Slider devices and how they function to open and close resealable closure mechanisms, in general, are taught, for example, in U.S. Pat. Nos. 5,063,644; 5,301,394; 5,442,837, and 5,664,229, each of which is incorporated by reference herein.

Figure 6:
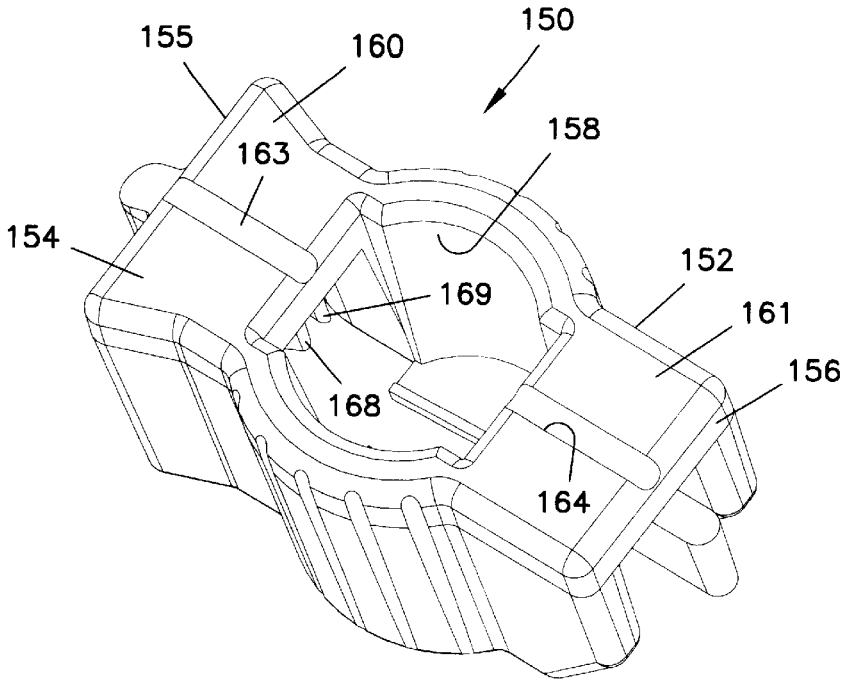
FIG. 6 is an enlarged, top perspective view of the slider device illustrated in FIGS. 1, 2 and 4.
Figure 7:
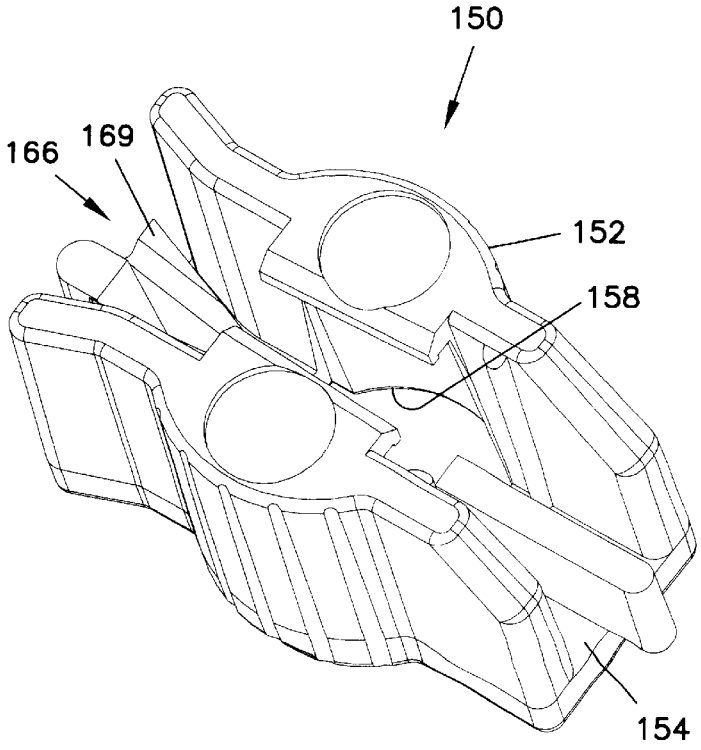
FIG. 7 is an enlarged, bottom perspective view of the slider device illustrated in FIGS. 1, 2 and 4.

An exemplary slider device is shown in FIGS. 6 and 7 in perspective view and preferably comprises a one-piece unitary, molded plastic member with no moveable parts that are moveable with respect to one another. In general, the slider device 150 includes a housing 152 for sidably engaging the closure mechanism 114. The housing 152 is movable between a closed position of the resealable package 110 when the housing 152 is adjacent the side edge 120 and an open position of the resealable package 110 when the housing 152 is adjacent the side edge 122. FIG. 1 illustrates the resealable package 110 in an open position. The housing 152 slides over the resealable closure mechanism 114 relative to the top edge 127 of the resealable package 110 to open and close the mouth 126.

The housing 152 is preferably a multi-sided container configured for engaging or locking onto or over the resealable closure mechanism 114. In the particular embodiment illustrated in FIGS. 6 and 7, the housing 152 includes a top wall 154. By the term "top", it is meant that in the orientation of the slider device 150 shown in FIG. 1, the wall 154 is oriented above the remaining portions of the housing 152. It should be understood, of course, that if the housing 152 is moved from the orientation shown in FIG. 1, the top wall 154 will not be in a top orientation. The top wall 154 defines a first end 155 and an opposite second end 156. The top wall 154 also defines an open aperture 158. The open aperture 158 divides the top wall 154 between a first portion 160 and a second portion 161. The first portion 160 generally comprises a flat, planar portion in extension from a periphery of the open aperture 158 to the edge defined by the first end 155. Similarly, the second portion 161 generally comprises a flat, planar portion in extension from a periphery of the open aperture 158 to the edge defined by the second end 156. Each of the first and second portions 160, 161 defines a groove 163, 164 respectively. The aperture 158 and grooves 163, 164 aid in providing a structure that may be more easily injection molded.

The housing 152 includes a separation structure for separating the first and second closure profiles 130, 131. That is, when the resealable closure mechanism 114 is in a closed state such that the closure members 134, 144 are interlocked, the separation structure will apply a force to wedge open and pull the closure members 134, 144 apart from each other. In the embodiment illustrated, the housing 152 includes a spreader 166 operating as a separation structure. The spreader 166, in the preferred embodiment shown, extends or depends from the top wall 154. Preferably, the spreader 166 comprises first and second angled wedges 168, 169 having a gap 170 (FIG. 4) formed therebetween.

Referring again to FIG. 1, the resealable closure mechanism 114 includes structure to ensure complete interlocking of the closure profiles 130, 131 when the slider device 150 is in the closed position. In general, the resealable closure mechanism 114 includes a void arrangement that helps to hold the closure profiles 130, 131 close to, or immediately adjacent to, the slider device 150. Accordingly, when the slider device 150 is in the closed position, the upper flanges 139, 147 of the resealable closure mechanism 114 conform to the slider device 150. By "conform," it is meant that the upper flanges 139, 147 adhere to the shape, out line , or contour of the slider device 150 when it is positioned in the closed position. In many instances, the conformance of the resealable closure mechanism 114 includes direct contact between the upper flanges 139, 147 and the slider device 150.

Figure 2:
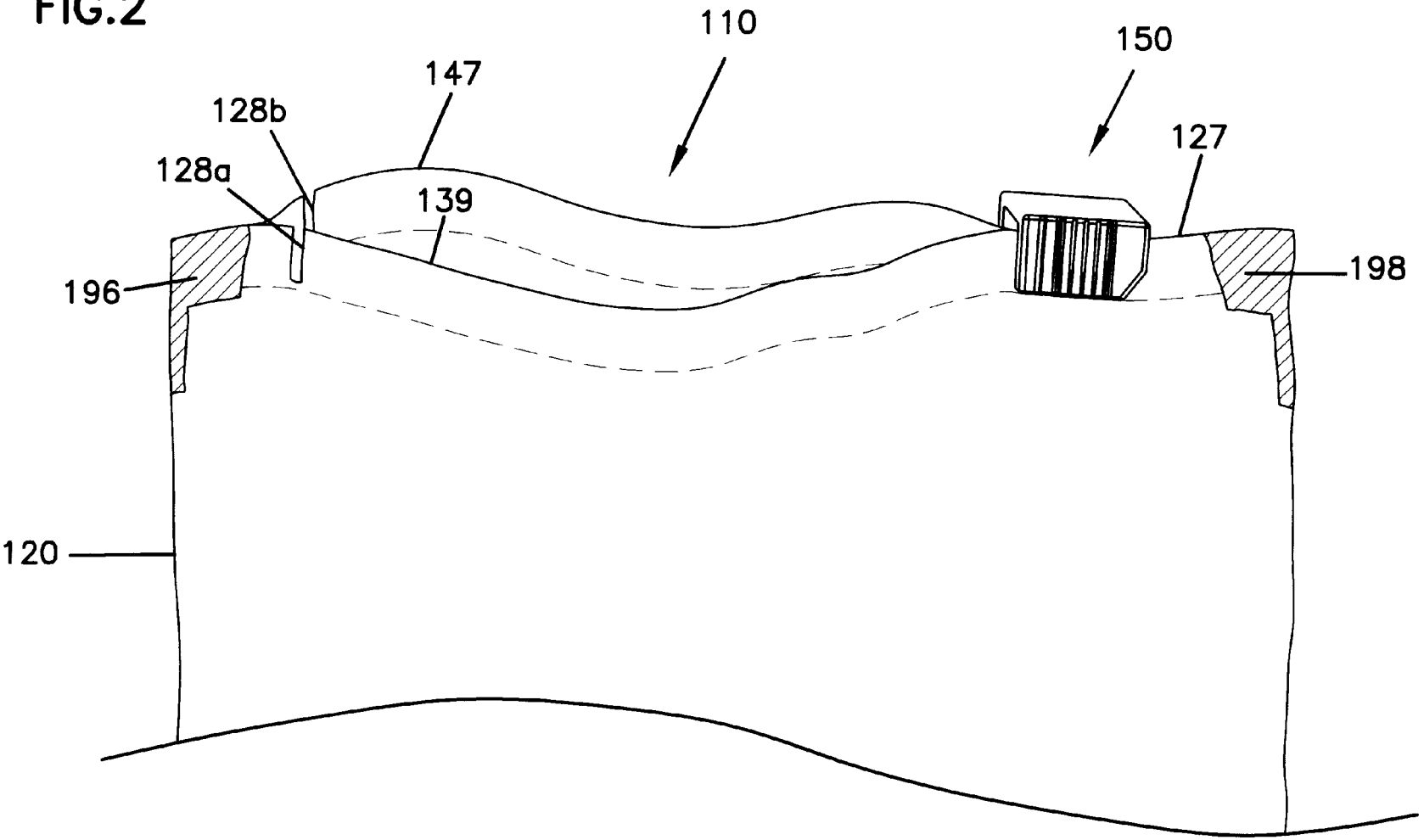
FIG. 2 is a fragmented, schematic, side perspective view of the flexible, resealable package of FIG. 1.

In the particular embodiments illustrated in FIGS. 1–4, the void arrangement includes an opening, gash, incision, or slit arrangement 128 formed in the resealable closure mechanism 114. Specifically, the slit arrangement 128 includes a first slit 128*a* formed in the upper flange 139 (FIG. 2) of the first closure profile 130 and a second slit 128*b* formed in the upper flange 147 of the second closure profile 131 (FIG. 2). The slit arrangement 128 allows the upper flanges 139, 147 to expand and, thereby, accommodate and/or conform to the slider device 150 when it is in the closed position. Thus, the slit arrangement 128 ensures a complete interlocking of the closure profiles 130, 131 when the slider device 150 is in its closed position.

Figure 3:
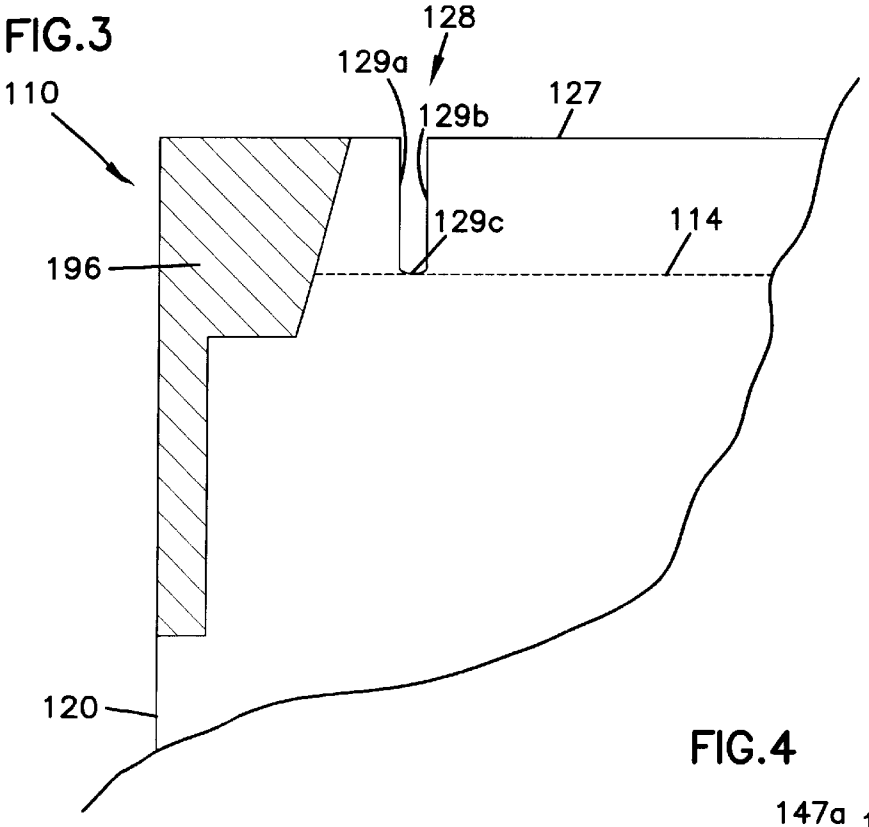
FIG. 3 is an enlarged, fragmented, side elevational, schematic view of a portion of the flexible, resealable package of FIGS. 1 and 2.

While many embodiments of the slit arrangement 128 are contemplated, the first and second slits 128*a*, 128*b*, in the illustrated embodiment, are generally "U-shaped." In particular, the preferred slit arrangement 128 is formed in the upper flanges 139, 147 substantially perpendicular to the resealable closure mechanism 114 and substantially parallel to the two side edges 120, 122. As shown in FIG. 3, the slit arrangement 128 includes a first edge segment 129*a* and a second edge segment 129*b* joined together by a curved bight section 129*c*. In one embodiment, the slit 128 extends from the top edge 127 of the package to the resealable closure mechanism 114. Furthermore, the slit 128 has a width between of at least about 0.005 inches (about 0.127 mm) and no greater than about 0.035 inches (about 0.900 mm), typically about 0.008–0.020 inches (about 0.203–0.508 mm), and in preferred embodiments about 0.01–0.015 inches (about 0.254–0.381 mm). The method of manufacturing a package having the slit 128 will be described in greater detail below.

The slit arrangement 128 serves as a "parking place" for a slider device 150 and also facilitates mounting the slider device 150 onto the resealable package 110 during initial assembly. In a preferred embodiment, the slit arrangement 128 is formed in the upper flanges 139, 147 (FIG. 2) of the resealable closure mechanism 114 near a side edge of the resealable package 110. For example, in the embodiment shown in FIG. 1, the slit arrangement 128 is formed near side edge 120. Additionally, the edge segment 129*a* (FIG. 3) closest to the side seal 120 helps to create a stop member for the slider device 150.

Figure 4:
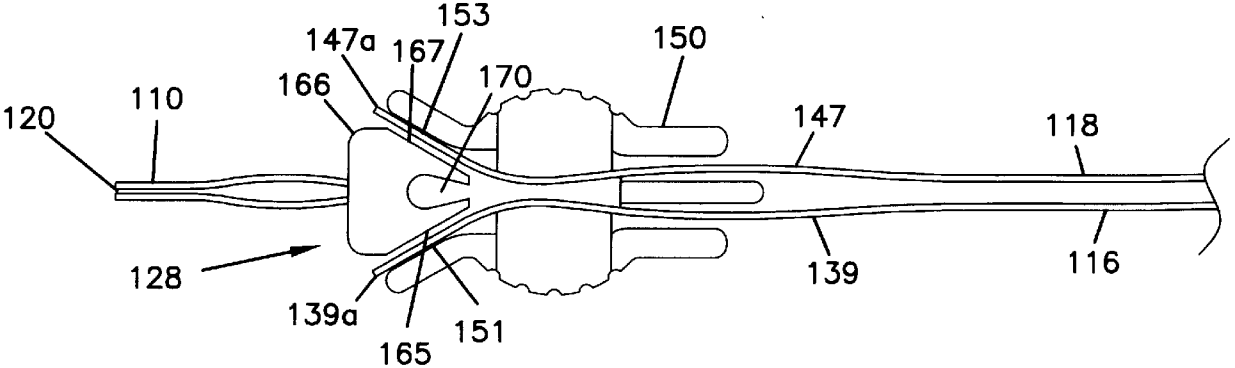
FIG. 4 is a bottom plan view of a slider device illustrated in FIGS. 1–3 oriented on a portion the resealable package of FIG. 1.

An enlarged top view of the resealable package 110 is shown in FIG. 4 having the slider device 150 positioned within the slit arrangement 128. The slit arrangement 128 accommodates the slider device 150 such that the upper flanges 139, 147 conform to the slider device 150 when the slider device 150 is positioned within the slit arrangement 128. Specifically, in the embodiment shown in FIG. 4, the slit arrangement 128 accommodates the spreader 166 such that the upper flanges 139, 147 conform to the spreader when the slider device is positioned within the slit arrangement 128. By "conform," it is meant that the upper flanges 139, 147 adhere to the shape, outline, or contour of the slider device 150 when it is positioned in the closed position.

As shown in FIG. 4, the flange edge portions 139*a*, 147*a* nearest the slit arrangement 128 are maintained within the slider device 150 when the slider device 150 is positioned within the slit arrangement 128. For example, the flange edge portion 139*a* is sandwiched or trapped between the side wall 165 of the spreader 166 and the corresponding inner side wall 151 of the slider device 150. Similarly, the opposite flange edge portion 147*a* is sandwiched or trapped between the side wall 167 of the spreader 166 and the corresponding inner side wall 153 of the slider device 150. Accordingly, the slit arrangement 128 helps to hold the closure profiles 130, 131 close to, or immediately adjacent to, the spreader 166. Thus, the slider device 150 supports the flange edge portions 139*a*, 147*a* when the slider device 150 is positioned with the slit arrangement 128. By "support," it is meant that the slider device 150 maintains direct contact with the upper flanges 139, 147 and the slider device 150, thereby, maintaining the flange edge portions 139*a*, 147*a* in a substantially coplanar orientation with respect to the upper flanges 139, 147. In so doing, the slit arrangement 128 decreases the tendency for an incomplete interlock between the first and second closure profiles 130, 131.

Figure 8:
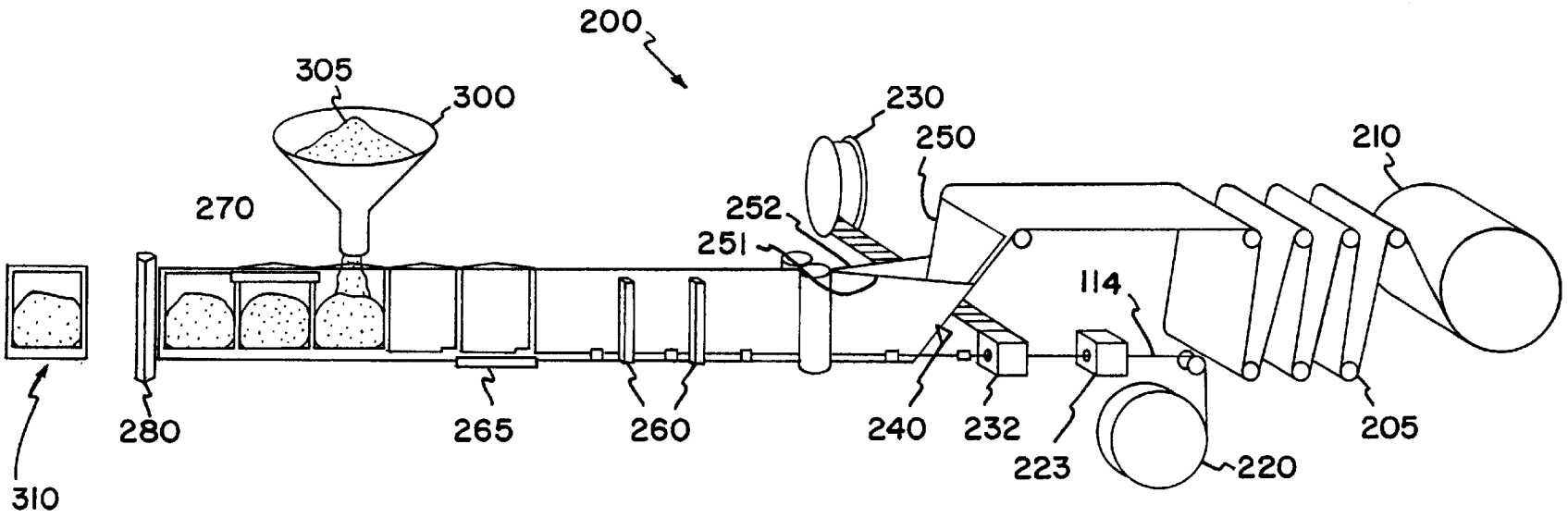
FIG. 8 is a schematic, perspective view of an apparatus for manufacturing and filling packages having a resealable closure mechanism and slider device attachment, such as those illustrated in FIGS. 1–4.
Figure 10:
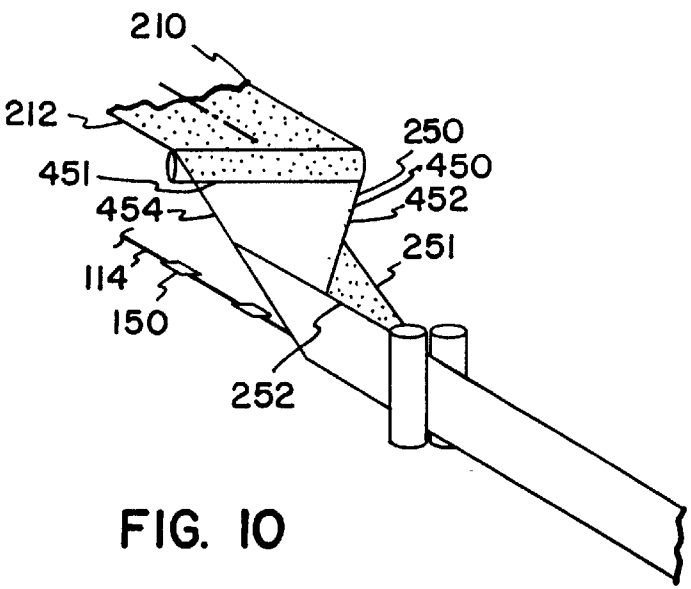
FIG. 10 is an enlarged, schematic, perspective view of a portion of the process depicted in FIGS. 8 and 9, viewed from the opposite side of FIGS. 8 and 9.
Figure 9:
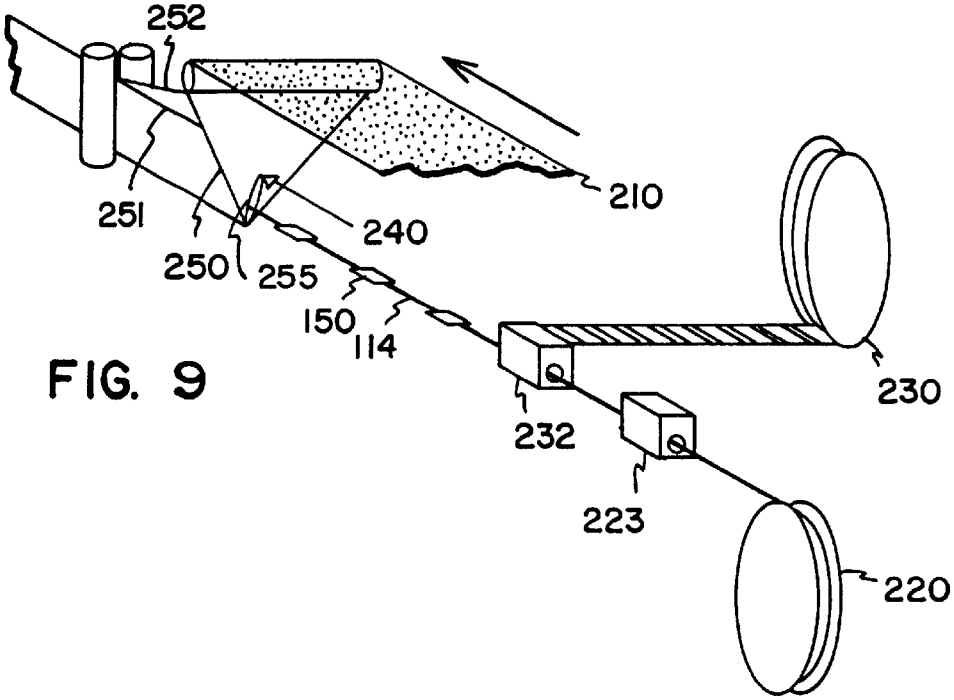
FIG. 9 is an enlarged, schematic, perspective view of a portion of the process depicted in FIG. 8.

Referring now to FIGS. 8, 9 and 10, a process 200 for manufacturing resealable packages, in accordance with the present disclosure, is shown. An exemplary manufacturing process is described in currently pending Provisional Patent Application Ser. No. 09/467854 entitled "METHODS OF MANUFACTURING RECLOSABLE PACKAGE HAVING A SLIDER DEVICE," the entire disclosure of which is incorporated by reference herein.

While many embodiments of the process for manufacturing resealable packages are contemplated, the process lines, illustrated in FIGS. 8 and 9, progress from right to left; that is, the final filled package is at the left of the figures. The bag or package is manufactured upside-down so that the filling takes place through the bottom of the bag. Throughout this disclosure, the side of the bag having the zipper closure will be referred to as the "top" of the bag.

Polymeric film 210, which will provide the first and second opposed panel sections 116, 118 is provided on a roll. In another embodiment, the film 210 may be extruded or otherwise formed immediately before this horizontal form, fill and seal process, thereby eliminating the step of winding the film after forming and then unwinding when the bags are made and filled. A series of tensioners 205 helps to control the tension on the film 210 during the manufacturing process. From the tensioners 205, the film 210 progresses to a "V-board" 250 where the film 210 is folded. A slitter knife 240 close to the base of the V-board 250 slits film 210 into two webs of film 251, 252. Additional features of the V-board 250 are discussed below.

An extended length of the resealable closure mechanism 114 (with first closure profile and second closure profile interlocked) is provided via spool 220 simultaneously with the film 210. A slit arrangement 128 (FIG. 1) is formed into the upper flanges 139, 147 (FIG. 2) of the resealable closure mechanism 114 using a cutting device 223. In one embodiment of the invention, the cutting device 223 is an inexpensive device used to form the slit arrangement 128. For example, the cutting device 223 can include a knife or blade mounted on the end of a rotary device, for example, a motor or rotary actuator. Accordingly, the capital costs required to manufacture the package can be reduced.

Referring still to FIGS. 8 and 9, a slider device 150, provided from a spool 230, is parked into the slit 128 formed in the resealable closure mechanism 114 by applicator 232. If misaligned on the resealable closure mechanism 114 or the slit arrangement 128, the slider device 150 can be phased into alignment with the slit arrangement 128 by sliding or moving the slider device 150 along the resealable closure mechanism 114 until the slider device 150 is aligned with the package slider "park" or "closed" position, that is, slit arrangement 128. As discussed above, the slit arrangement 128 in the resealable closure mechanism 114 allows the resealable closure mechanism 114 to conform to the shape of the slider device 150 when it is positioned in its "closed" or "parked" position.

In a preferred embodiment of the invention, the cutting device 223 cuts the slit arrangement 128 into the upper flanges 139, 147 of the resealable closure mechanism 114 in a continuous procedure, for example, while the resealable closure mechanism 114 is being unwound from the spool 220. Alternately, the cutting device 223 cuts the slit arrangement 128 into the upper flanges 139, 147 of the resealable closure mechanism 114 in a step-wise function. For example, the resealable closure mechanism 114 can be incrementally indexed to the cutting device 223 and to applicator 232. The resealable closure mechanism 114 would be indexed a distance generally equal to the width of the package from first edge 120 to the second edge 122 (FIG. 1). In such a process, it may be preferable to include various tensioner rolls to compensate for the incremental feeding of the resealable closure mechanism 114.

The resealable closure mechanism 114 with the parked slider device 150 is fed between the film halves 251, 252 of film 210. A pair of guides or fingers (not illustrated) may be used to spread apart film halves 251, 252 to allow easier passage of the combined resealable closure mechanism 114 slider device 150 therethrough. With this arrangement, the combined resealable closure mechanism 114 and slider device 150 can be fed between the film halves 251, 252 without having to progress through bends or around rollers. That is, the combined resealable closure mechanism 114 and slider device 150 is allowed to travel in a straight configuration from the point where slider device 150 is applied to the resealable closure mechanism 114 to the point where the combined resealable closure mechanism 114 and slider device 150 are attached to film halves 251, 252. Preferably, once attached to film halves 251, 252, the straight configuration (i.e., with no bends or turns) is maintained.

V-board 250, as used in the method of the present disclosure, bends and configures film 210 into the desired form, and is instrumental in applying the resealable closure mechanism 114 with the parked slider device 150 to the film halves 251, 252. Slitter knife 240, for slitting into film halves 251, 252, is positioned at or near the bottom of V-board 250.

As illustrated in FIGS. 8, 9 and 10, V-board 250 is a generally two-dimensional board defined by a triangular face 450 with a top edge 451 and two angled edges 452, 454. Generally, the board is "V" shaped. A flat sheet of film 210 is folded into two halves by passing the film against the two angled edges 452, 454 of V-board 250. As best seen in FIG. 10, film 210 is brought behind the top edge 451 and face 450 of the board, and is then folded by the two angled edges 452, 454.

Preferably, V-board 250 includes a slot, slit, hole, or other aperture 255 (FIG. 8) through its face near the slitter knife 240 to accommodate passing the resealable closure mechanism 114 and slider device 150 therethrough. In accordance with the present disclosure, the resealable closure mechanism 114 is fed into slot 255 at the base of the V-board 250, preferably fairly soon after slitter knife 240 produces film halves 251, 252 from film 210. The slot 255 allows the resealable closure mechanism 114 to be brought between the film halves 251, 252 without a need for bending or turning comers with the resealable closure mechanism 114 with slider device 150.

In the exemplary manufacturing process illustrated in FIGS. 7–9, the resealable, flexible package is manufactured upside-down (that is, the bottom edge 125 will be at the top of the line, and the "top" of the bag is at the bottom of the line). As a result, the resealable closure mechanism 114, with the parked slider device 150, is positioned at the bottom of the film halves 251, 252.

Heated seal bars 260 provide vertical seals on the film and zipper closure combination. These vertical seals will eventually result in the two side edges 120, 122 of the package 110 in FIG. 1. In one embodiment, a single heated seal bar 260 is used. In a second embodiment, a plurality of heated seal bars 260 is used. Typically, each seal bar 260 has a first bar and a second bar (not illustrated) on opposite sides of the film. Heat may be provided from one or both sides; additionally and/or alternatively, the temperature from one side to another may be the same or may be different. Multiple seal bars, such as shown in FIG. 8, may be heated to different temperatures. The process may be designed so that each seam area is contacted by multiple seal bars, or by only one bar. Rollers can be used as desired to feed and stabilize the film and zipper closure.

Top seal bar 265, positioned at the bottom of the line, seals the resealable closure mechanism 114 to the film halves 251, 252. The resealable closure mechanism 114 includes an elongated first closure profile 130 and an elongated second closure profile 131 that are capable of being interlocked. Therefore, after the film halves 251, 252 are attached to the two closure profiles 130, 131 the package is ready to accept items or material 305 into the interior 124 as shown in FIG. 8. After the package is filled, a bottom seal bar 270, positioned at the top of the line, seals the bottom edge 125 (FIG. 1) of the package.

The above specification and examples are believed to provide a complete description of the manufacture and use of particular embodiments of the invention. Many embodiments of the invention can be made without departing from the spirit and scope of the invention.

What is claimed is:

1. A flexible package comprising:

(a) a package surrounding wall having a first side edge, a second side edge, a top edge extending between the first and second side edges, and a mouth between the first and second side edges; said mouth providing access to a package interior;

(b) a recloseable zipper along said mouth for selective opening and closing of said mouth; said zipper including first and second closure profiles;

(i) said first profile having a first upper flange; and (ii) said second profile having a second upper flange;

(c) a slider device operably mounted on said zipper for selectively opening and closing said zipper;

(d) each of said first and second upper flanges defining a void arrangement adjacent to said first side edge for accommodating said slider device such that said first and second upper flanges conform to said slider device when said slider device is positioned within said void arrangement;

(i) said void arrangement including a slit arrangement comprising: a first slit defined by the upper flange of the first closure profile, and a second slit defined by the upper flange of the second closure profile; and (ii) each of said first and second slit extending from said top edge.

2. The flexible package according to claim 1 wherein:

(a) said first slit includes a first edge segment and a second edge segment each extending from said top edge and joined together by a bight section; and (b) said second slit includes a first edge segment and a second edge segment each extending from said top edge and joined together by a bight section.

3. The flexible package according to claim 1, wherein:

(a) said slider device supports said first and second upper flanges when said slider device is positioned within said slit arrangement.

4. The flexible package according to claim 1, wherein:

(a) said slider device includes:

(i) a top wall; and (ii) a spreader depending from said top wall for separating said first and second closure profiles; and (b) said slit arrangement accommodates said spreader such that said first and second upper flanges conform to said spreader when said spreader is positioned within said slit arrangement.

5. The flexible package according to claim 4, wherein:

(a) said spreader supports said first and second upper flanges when said spreader is positioned within said slit arrangement.

6. The flexible package according to claim 1 wherein:

(a) a width of each of said first and second slits is less than about 0.900 millimeters.

7. The flexible package according to claim 1 wherein:

(a) each of said first and second closure profiles extends along said mouth between said first and second side edges; and (b) said slit arrangement is substantially perpendicular to each of said first and second closure profiles.

8. A recloseable zipper arrangement comprising:

(a) first and second closure profiles configured to selectively resealably engage;

(i) said first profile having a first upper flange with a top edge; and (ii) said second profile having a second upper flange with a top edge;

(A) each of said first and second upper flanges defining a void arrangement;

(B) said void arrangement including a slit arrangement comprising: a first slit defined by the first upper flange of the first closure profile, and a second slit defined by the second upper flange of the second closure profile;

(C) each of said first and second slit extending from the top edges of the first and second upper flanges; and (b) a slider device operably mounted on said first and second closure profiles for selectively engaging and disengaging said first and second closure profiles when the slider device is moved along the first and second upper flanges;

(i) said void arrangement oriented to accommodate said slider device such that said first and second upper flanges conform to said slider device when said slider device is positioned within said void arrangement.

9. The recloseable zipper arrangement of claim 8 wherein:

(a) a portion of each of said first and second upper flanges is sandwiched within said slider device when said slider device is positioned within said slit arrangement.

10. The recloseable zipper arrangement of claim 8 wherein:

(a) said slider device includes:

(i) a top wall; and (ii) a spreader depending from said top wall for separating said first and second closure profiles;

(b) said slit arrangement accommodates said spreader such that said first and second upper flanges conform to said spreader when said spreader is positioned within said slit arrangement.

11. The recloseable zipper arrangement of claim 10, wherein:

(a) said spreader supports said first and second upper flanges when said spreader is positioned within said slit arrangement.

12. A method of manufacturing a reclosable package, the method comprising:

(a) providing a resealable closure mechanism having a first closure profile and a second closure profile;

(i) the first profile having a first upper flange; and (ii) the second profile having a second upper flange;

(A) each of the first and second upper flanges defining a void arrangement;

(B) the void arrangement including a slit arrangement comprising: a first slit defined by the first upper flange of the first closure profile, and a second slit defined by the second upper flange of the second closure profile;

(C) each of the first and second slit extending from the top edges of the first and second upper flanges; and (b) orienting a slider device on the resealable closure mechanism to interlock the first closure profile with the second closure profile when the slider device is moved in a first direction, and to disengage the first closure profile from the second closure profile when the slider device is moved in a second opposite direction;

(i) the void arrangement being oriented to trap the first and second upper flanges between portions of the slider device, when the slider device is moved in the first direction; and (c) incorporating the resealable closure mechanism with the slider device mounted thereon into a resealable package.

13. The method according to claim 12 wherein the step of incorporating the resealable closure mechanism with the slider device into a resealable package further comprises:

(a) incorporating the resealable closure mechanism with the slider device mounted thereon into the resealable package such that the void arrangement is positioned adjacent to a side edge of the package.

14. The method according to claim 12 wherein the step of orienting includes:

(a) positioning the slider device within the void arrangement to trap the first and second upper flanges between a spreader on the slider device and a respective sidewall of the slider device.

15. The method according to claim 12 wherein the step of providing a resealable closure mechanism further comprises:

(a) providing a resealable closure mechanism including the first and second slits each being u-shaped.

16. A method of using a reclosable package having a resealable closure mechanism and a slider device; the package having a pair of side edges and a top edge defining a mouth extending between the side edges, the method comprising:

(a) providing a resealable closure mechanism having a first closure profile and a second closure profile; the first profile having a first upper flange and the second profile having a second upper flange; each of the first and second upper flanges defining a slit arrangement; the slit arrangement comprising a first slit defined by the first upper flange of the first closure profile, and a second slit defined by the second upper flange of the second closure profile, each of the first and second slits extending from the top edge of the package; the resealable closure mechanism having an open position and a closed position; the closed position including the first and second profiles being interlocked, and the open position including the first and second profiles being disengaged;

(b) moving the slider device along the resealable closure mechanism to transform the resealable closure mechanism from the open position to the closed position; and (c) positioning the slider device within the slit arrangement such that the first and second upper flanges conform to the slider device.

17. The method according claim 16 further comprising:

(a) moving the slider device along the resealable closure mechanism from the closed position to the open position to provide access to an interior of the package.

18. The method according claim 16 wherein:

(a) said step of position the slider device within the slit arrangement includes:

(i) trapping the first upper flange between a first sidewall of the slider device and a spreader of the slider device; and (ii) trapping the second upper flange between a second sidewall of the slider device and the spreader of the slider device.

* * * * *